US006630087B1

(12) United States Patent
Hancock et al.

(10) Patent No.: US 6,630,087 B1
(45) Date of Patent: Oct. 7, 2003

(54) PROCESS OF MAKING LOW SURFACE ENERGY FIBERS

(75) Inventors: J. Gregory Hancock, Pensacola, FL (US); W. Keith Fisher, Suffield, CT (US); John Elliott, New Orleans, LA (US); David B. Horn, Longmeadow, MA (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 09/993,357

(22) Filed: Nov. 16, 2001

(51) Int. Cl.[7] ..... D01D 5/12; D01D 5/32; D01D 5/34; D02G 3/02

(52) U.S. Cl. ..... 264/103; 264/172.14; 264/172.15; 264/210.8; 264/211.14

(58) Field of Search ..... 264/103, 172.14, 264/172.15, 210.8, 211.14

(56) References Cited

U.S. PATENT DOCUMENTS

| | | | |
|---|---|---|---|
| 3,118,011 | A | 1/1964 | Breen |
| 3,399,259 | A | 8/1968 | Brayford |
| 3,491,178 | A | 1/1970 | Nishioka et al. |
| 3,509,013 | A | 4/1970 | Oppenlander |
| 3,568,249 | A | 3/1971 | Matsui |
| 3,577,308 | A | 5/1971 | Van Drunen et al. |
| 3,608,148 | A | 9/1971 | Sluijters |
| 3,657,062 | A | 4/1972 | Eshima et al. |
| 3,725,192 | A | 4/1973 | Ando et al. |
| 3,726,955 | A | 4/1973 | Hughes et al. |
| 3,803,453 | A | 4/1974 | Hull |
| 3,900,678 | A | 8/1975 | Aishima et al. |
| 3,930,103 | A | 12/1975 | Chimura et al. |
| 3,969,559 | A | 7/1976 | Boe |
| 3,993,834 | A | 11/1976 | Chimura et al. |
| 4,059,949 | A | 11/1977 | Lee |
| 4,069,363 | A | 1/1978 | Segraves et al. |
| 4,075,378 | A | 2/1978 | Anton et al. |
| 4,145,473 | A | 3/1979 | Samuelson et al. |
| 4,263,691 | A | 4/1981 | Pakarnseree |
| 4,337,155 | A | 6/1982 | Sasaki et al. |
| 4,384,022 | A | 5/1983 | Fowler |
| 4,391,872 | A | 7/1983 | Suzuki et al. |
| 4,424,257 | A | 1/1984 | Bach |
| 4,657,718 | A | 4/1987 | Sicka et al. |
| 4,663,221 | A | 5/1987 | Makimura et al. |
| 4,708,080 | A | 11/1987 | Conrad |
| 5,154,934 | A | 10/1992 | Okamoto |
| 5,226,434 | A | 7/1993 | Britton et al. |
| 5,244,614 | A | 9/1993 | Hagen |
| 5,256,050 | A | 10/1993 | Davies |
| 5,260,013 | A | 11/1993 | Samuelson |
| 5,277,974 | A | 1/1994 | Kubo et al. |
| 5,311,890 | A | 5/1994 | Thornton |
| 5,313,909 | A | 5/1994 | Tseng et al. |
| 5,314,922 | A | 5/1994 | Takai |
| 5,352,518 | A | 10/1994 | Muramoto et al. |
| 5,353,820 | A | 10/1994 | Suhonen et al. |
| 5,372,885 | A | 12/1994 | Tabor et al. |
| 5,427,595 | A | 6/1995 | Pihl et al. |
| 5,445,884 | A | 8/1995 | Hoyt et al. |
| 5,468,555 | A | 11/1995 | Lijten et al. |
| 5,505,889 | A | 4/1996 | Davies |
| 5,520,924 | A | 5/1996 | Chapman et al. |
| 5,556,589 | A | 9/1996 | Sibal |
| 5,560,377 | A | 10/1996 | Donovan |
| 5,590,420 | A | 1/1997 | Gunn |
| 5,605,739 | A | 2/1997 | Stokes et al. |
| 5,618,479 | A | 4/1997 | Lijten et al. |
| 5,662,978 | A | 9/1997 | Brown et al. |
| 5,680,876 | A | 10/1997 | Hasham et al. |
| 5,697,390 | A | 12/1997 | Garrison et al. |
| 5,711,935 | A | 1/1998 | Hill et al. |
| 5,722,106 | A | 3/1998 | Masterman et al. |
| 5,752,278 | A | 5/1998 | Gunn |
| 5,807,490 | A | 9/1998 | Davis et al. |
| 5,807,633 | A | 9/1998 | Tamaru et al. |
| 5,829,057 | A | 11/1998 | Gunn |
| 5,832,636 | A | 11/1998 | Lyden et al. |
| 5,837,179 | A | 11/1998 | Pihl et al. |

(List continued on next page.)

FOREIGN PATENT DOCUMENTS

| | | | |
|---|---|---|---|
| JP | 06116816 A | * | 4/1994 |
| WO | 97/20974 A1 | | 6/1997 |

OTHER PUBLICATIONS

Abstract of Japanese application No. 56058085 (publication No. 57171720, Oct. 22, 1982) No Translation.

Abstract of Japanese 02251653A, Oct. 9, 1990 No translation.

"Surface Energetics of Nylon 66 Fibers", Martha L. Tate, Yashavanth K. Kamath, Sheldon P. Wesson and Sigrid B. Ruetsch, Art. No. 0072, J. of Colloid and Interface Science, 177, 579–588 (1996).

*Primary Examiner*—Leo B. Tentoni
(74) *Attorney, Agent, or Firm*—Howrey Simon Arnold & White, LLP; John P. Foryt

(57) ABSTRACT

The present invention relates to a textile filament with a contact angle greater than or equal to 90 degrees. Such filaments are either water-repellent or resistant to chemicals, and yarns made therefrom readily processible into fabrics. In a detailed embodiment, the filaments are water-repellent and comprise a first longitudinally-extending component comprising at least one polymer selected from nylon, polyester, polypropylene, or other filament-forming polymer, and a second longitudinally-extending component, comprising a halogenated polymer. In a second detailed embodiment, the filaments are chemical-resistant and comprise a first longitudinally-extending component comprising at least one fiber-forming polymer and a second longitudinally-extending component comprising an olefin copolymer. In both embodiments, the second longitudinally-extending component is present on the exterior of the first longitudinally-extending component. The present invention also relates to yarns made from the filaments, and fabrics made from the yarns, as well as methods of making the yarns and the fabric.

23 Claims, 3 Drawing Sheets

U.S. PATENT DOCUMENTS 5,871,836 A 2/1999 Schultink et al.
5,958,806 A 9/1999 Jensen et al.
6,057,414 A 5/2000 Razavi
6,287,689 B1 9/2001 Elliott et al.

* cited by examiner

Figure 1 Typical Spun Fiber Cross-Section (magnification: x 1000)
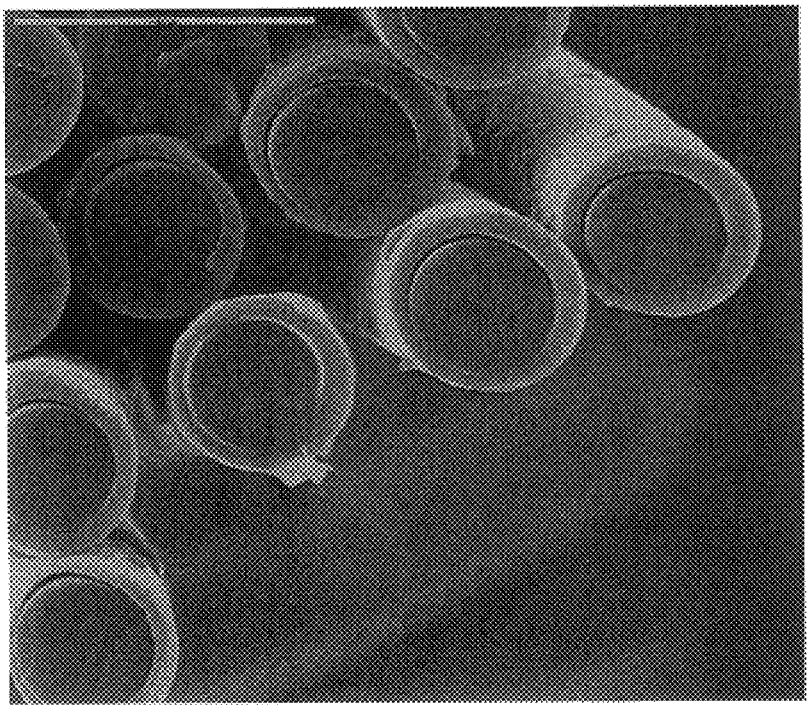
Figure 2 Staple, Drawn Fiber (magnification: x 1250)
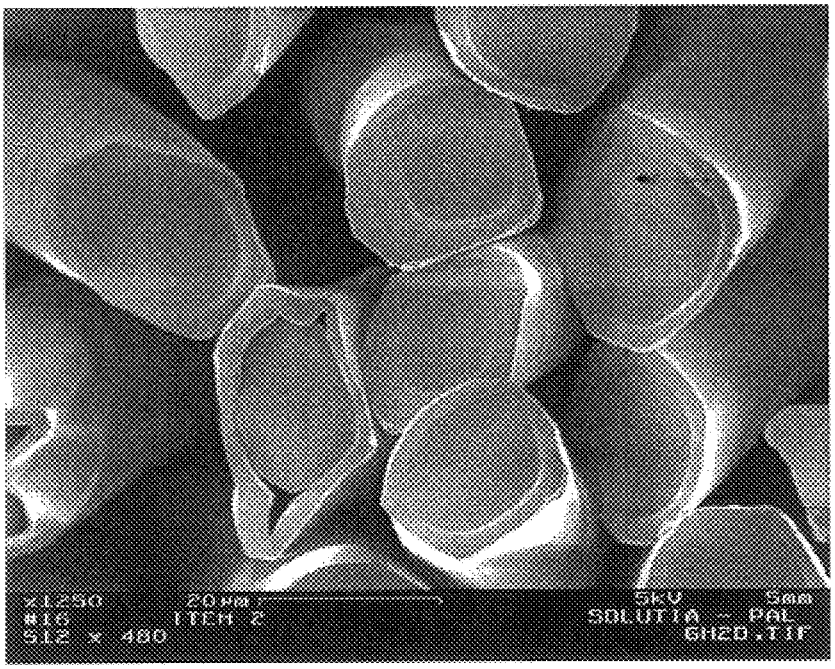

Figure 3 Drawn Yarn, 2-Step (magnification: x 1000)
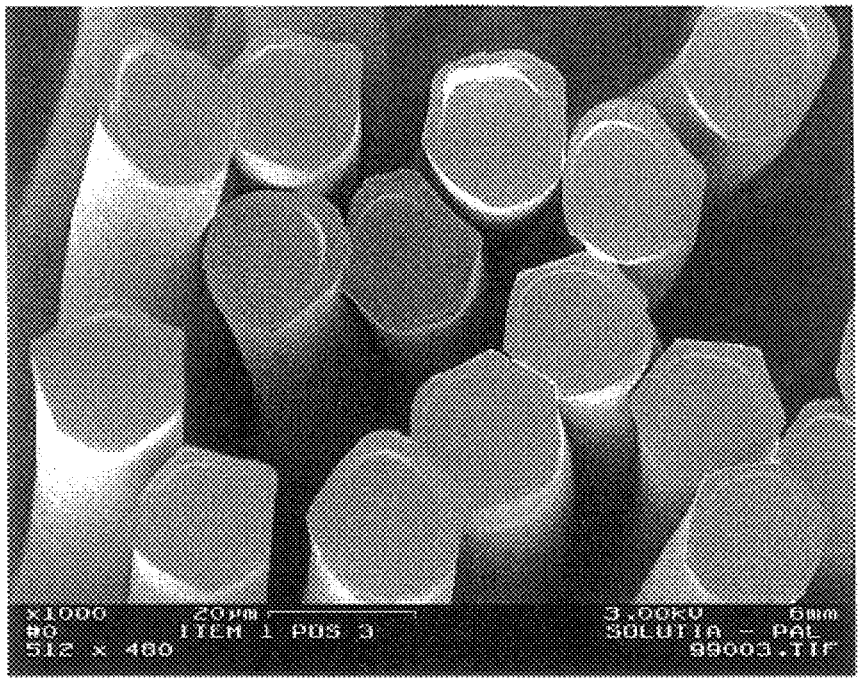
Figure 4 Single Step Drawn Yarn
(magnification: x 1000)
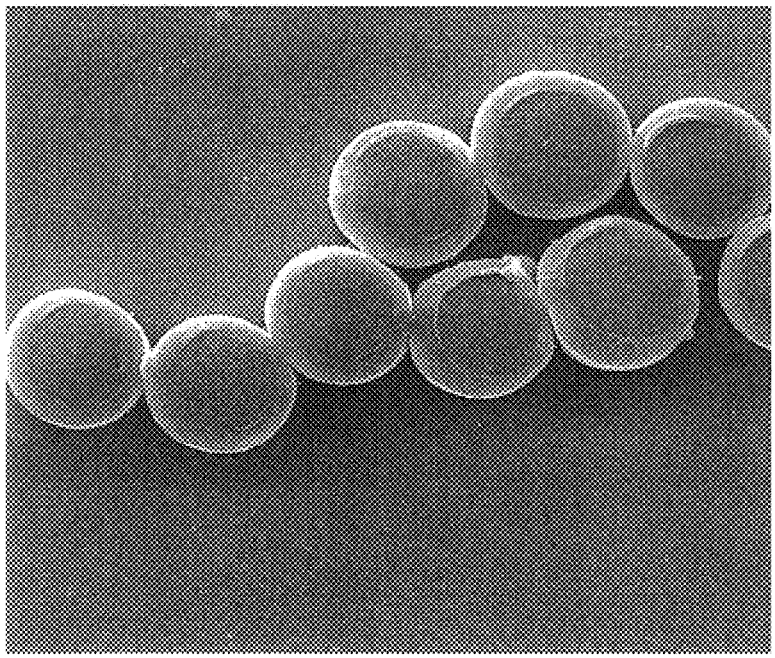

Figure 5 Qualitative Contact Angle Over Time
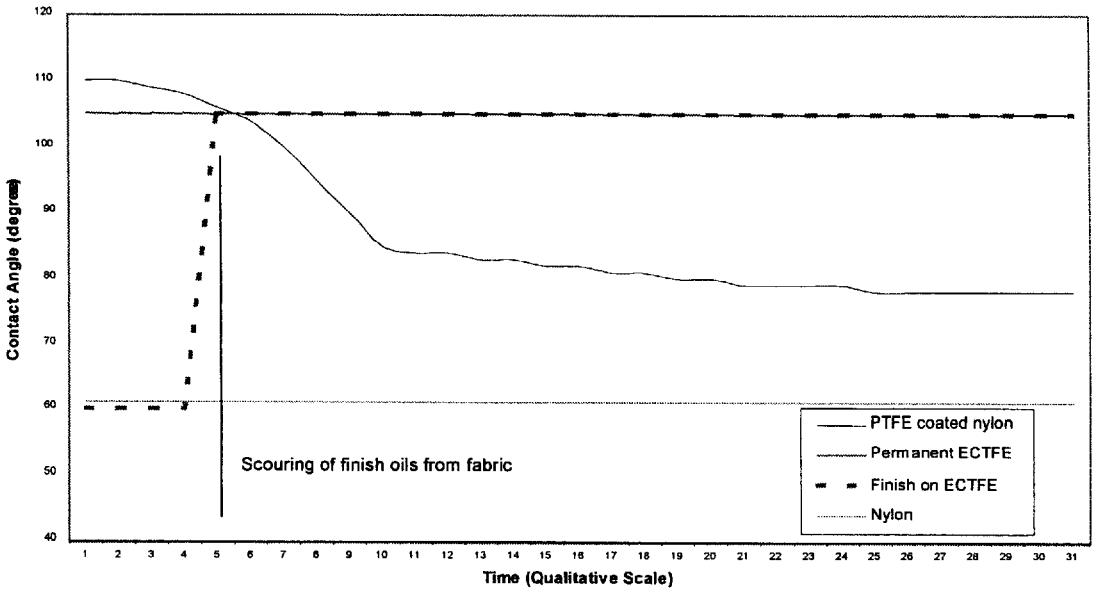

PROCESS OF MAKING LOW SURFACE ENERGY FIBERS

BACKGROUND OF THE INVENTION

1. Field of the Invention

The present invention relates generally to the fields of synthetic filaments and products made therefrom. More particularly, it concerns synthetic filaments that have both low surface energy and high strength.

2. Description of Related Art

Fabrics which are water-repellent (i.e. provide a barrier to moisture) while allowing the passage of water vapor and other gases are desirable for use in apparel, shoes, tents and camping equipment, packaging, medical apparel, and medical supplies. Such fabrics require fibers that have both a low surface energy to repel water and a strength high enough to be processible into a useful fabric. Other desirable fabrics are both water-repellent and do not allow the passage of water vapor and other gases, for use in packaging and medical supplies.

In packaging, protective apparel, and industrial filtration, a need exists for fabrics that are stable to both heat and chemicals. Such fabrics require fibers both low in surface energy and high enough in strength to be processible into a useful fabric, as well as heat and chemical resistance.

One class of water-repellent fabrics are those made by applying a finish to a fabric or its component filaments before or after the weaving or knitting process. The finish is intended to provide the low surface energy needed to repel water. However, such finishes tend to have poor durability and washfastness, and often require environmentally taxing application or post-treatment steps.

A second class of water-repellent fabrics is one comprised of water-repellent materials. An example of this class is a fabric comprising polytetrafluoroethylene (PTFE) sold by W.L. Gore Inc. under the trade name GORE-TEX®. Known uses of PTFE fabrics are chiefly lamination of the PTFE fabric to a textile fabric. This suggests that PTFE fabrics, although having low surface energy, do not have high enough strength to be useful fabrics per se.

Therefore, it is desirable to have a textile fabric made of filaments that exhibit low surface energy and strength high enough to be processible into useful fabrics. It is also desirable for such filaments to be produced by high throughput, economical spinning technology. Although filaments with a core/sheath structure wherein the sheath comprises a halogenated polymer are known (Chimura et al., U.S. Pat. Nos. 3,930,103 and 3,993,834), the core of the known filaments comprises primarily methyl methacrylate, and is not useful in forming textile fibers or filaments. Although core/sheath filaments wherein the core comprises nylon and the sheath comprises a grafted olefinic polymer are known, such as Tabor et al., U.S. Pat. No. 5,372,885, no such filaments are known to comprise a sheath useful in heat- and chemical-resistant textile applications.

SUMMARY OF THE INVENTION

In one embodiment, the present invention relates to a textile filament comprising a first longitudinally extending component formed of at least one filament-forming polymer, and a second longitudinally extending component formed of at least one polymer, wherein the second longitudinally extending component is in contact with the surface of the first longitudinally extending component, and wherein the filament has a contact angle greater than or equal to 90 degrees. In one embodiment, the first longitudinally extending component forms the core of the filament, and the second longitudinally extending component is in the form of a sheath that surrounds the circumference of the core. In another embodiment, the second longitudinally extending component is in the form of one or more stripes located on the surface of the first longitudinally extending component.

In another embodiment, the present invention relates to a yarn, wherein the yarns comprise a plurality of filaments as described above. The yarn may possess a contact angle greater than 90 degrees. The present invention also relates to a fabric comprising a plurality of said yarns. The spacing between the yarns may be sufficiently small to provide a barrier to liquids and sufficiently large to allow the passage of gases, or is sufficiently small to provide a barrier to liquids and to gases. The fabric may possess a contact angle greater than 90 degrees.

In a further embodiment, the present invention relates to a laminate that comprises a plurality of yarns, fabrics and/or filaments as described above. The laminate may possess a contact angle greater than or equal to 90 degrees.

Another embodiment of the present invention relates to a process for making a method for producing a low surface energy filament comprising, melting a first component comprising at least one filament-forming polymer; melting a second component comprising at least one polymer; extruding said first component and said second component to form a filament, wherein said second component is formed on said first component; quenching said filament; and drawing said filament; wherein said filament possesses a contact angle greater than or equal to 90 degrees.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1, is a scanning election microscope (SEM) image (magnification×1000) of cross-sections of filaments having a nylon 6,6 core surrounded by a Halar® sheath. The bicomponent filaments are not drawn.

FIG. 2 is a SEM image (magnification×1000) of cross-sections of filaments having a nylon 6,6 core and a Halar® sheath wherein the filaments are in the form of drawn staple fiber.

FIG. 3 is a SEM image (magnification×1000) depicting cross-sections of filaments having a nylon 6,6 core and a Halar® sheath formed by a two-step process, the first step being the spinning of partially oriented fibers, the second step being the drawing of these fibers.

FIG. 4 is a SEM image (magnification×1000) illustrating cross-sections of filaments having a nylon 6,6 core and a Halar® sheath formed by a one-step process.

FIG. 5 is a graph demonstrating the water repellency of an embodiment of the present invention compared to other conventional outerware materials.

DESCRIPTION OF ILLUSTRATIVE EMBODIMENTS

The terms "filament" and "fiber" may be used interchangeably as referenced to herein. The terms "fiber" and "filament" may include continuous and/or staple fiber.

In one aspect, the present invention relates to a filament comprising a first longitudinally extending component comprising at least one filament-forming polymer and a second longitudinally extending component comprising at least one polymer, wherein the second longitudinally-extending component covers at least part of the first longitudinally-extending component and the filament has a contact angle greater than or equal to 90 degrees. Such a filament may be herein termed a "bicorhponent filament." Contact angle, dispersive surface energy, and non-dispersive work of adhesion can be measured by methods known in the art (Tate et al., *J. Colloid and Interface Sci.*, 177, 579–588 (1996)). Typically, filaments with a contact angle greater than or equal to 90 degrees have a non-dispersive work of adhesion in water equal to or less than 26 mN/m. In another aspect, the filament of the present invention may possess a tenacity of more than 2.0 g/den. Tenacity can be measured by techniques known to those skilled in the art. Exemplary techniques are described in the Examples below or in procedures such as ASTM D 3822-96 or later revisions.

In a first class of embodiments of this aspect, the present invention is directed to filaments comprising a first longitudinally extending component comprising at least one melt-processible, fiber-forming polymer including, but not limited to polyamides (e.g., nylons), polyesters (e.g., PET, PBT, 3GT, PTT, etc.) and polyolefins (polypropylene, polyethylene, poly (methyl pentene), etc.) or other filament-forming, melt-processible, fiber-forming polymer, and a second longitudinally extending component present on the surface of the first longitudinally extending component, comprising a halogenated polymer. Such filaments have a low surface energy and may have a high tenacity. The low surface energy makes the filaments resistant to moisture, and the high tenacity makes the filaments processible into yarns and/or fabric. The term "yarns" shall include woven, knitted, twisted, intermingled or otherwise combined staple fibers, continuous filaments, threads, yarns and/or combinations thereof. The term "fabric" shall be synonomous with web, felt and/or fabric-like materials and shall include woven, knitted, sewn and/or nonwoven filaments, yarns and combinations thereof. The term "laminate" shall include one or more of filaments, yarns or fabrics formed by any lamination process, including but not limited to compression, adhesion, stapling, bonding, sewing or other acceptable lamination processes. The term "nonwoven" shall include melt-blowing, wet-laying, air-intermingling and/or any other web forming means.

A filament of the present invention has a contact angle greater than or equal to 90 degrees. This provides for the filament to be water repellent. In one embodiment, the filament has a core/sheath structure in which the sheath surrounds the core. Hereinafter, "surrounding the core" shall mean covering enough of the core so as to give sufficient halogenated polymer on the surface of the fiber to provide a contact angle greater than or equal to 90 degrees. Typically, the sheath will cover about 90% or more of the outer surface of the core, and preferably, the sheath will cover 100% of the outer surface of the core. The core and sheath can be of any sectional profile (e.g. circular, pentalobal, etc.). A typical, but not limiting, profile is a circular core surrounded by a ring of sheath.

In a second embodiment, the filament has a "racing stripe" structure in which the halogenated polymer component is present in the form of longitudinal stripes on the external face of the first longitudinally extending component. The number of longitudinal stripes is selected so as to give sufficient halogenated polymer on the surface of the fiber to provide a contact angle greater than or equal to 90 degrees.

The optimal sectional profile to be used in a filament will depend on the intended application of the filament and will be readily determined by one skilled in the art.

The first longitudinally extending component of the filament comprises at least one melt-processible, fiber-forming polymer including, but not limited to polyamides (e.g. nylons), polyesters (e.g., PET, PBT, 3GT, PTT, etc.), polyolefins (e.g., polypropylenes, polyethylene, poly (methyl pentene), etc.), or other filament-forming polymer. Any polymer known to those skilled in the art to be useful in the melt or solution spinning production of textile filaments can be used in the present invention. Polymers of nylon, polyester, and polypropylene are known to have sufficiently high tenacity to be useful in the production of textile filaments. Typically, such polymers have poor light transmittance, in distinction to the core polymers disclosed by Chimura et al., cited above. It is desirable for a filament-forming polymer to have crystallization rates and/or elongational viscosity similar to those same properties of the halogenated polymer of the second longitudinally-extending component in order to better share spinning stress.

Filament-forming polymers that can be used in the first longitudinally-extending component include, but are not limited to polyamides such as nylon 6,6, other nylons, polyesters such as polybutylene terephthalate, other polyesters, and polyolefins such as polypropylene. Nylon 6,6 and polyester are preferred. Other filament-forming polymers that may be used in the present invention will be clear to one skilled in the art.

The first longitudinally-extending component of the filament can also include additives such as nucleating agents, flame retardants, lubricants, surface active agents and colorants, among other additives. Additives can be added to the molten first longitudinally-extending component prior to extrusion of the filament. Nucleating agents may be useful in increasing the crystallization rate of the first longitudinally-extending component to more nearly match that of the second longitudinally-extending component. If it is desired to color the filament by coloring the first longitudinally-extending component, then colorants can be added to the molten first longitudinally-extending component before coextrusion with the second longitudinally-extending component. Typically, colorants in the present invention will be solid pigments dispersed in either a carrier polymer or blended beforehand in the first longitudinally-extending component polymer, wherein the carrier polymer can be selected for compatibility with the first longitudinally-extending component polymer by one skilled in the art. Other additives that can be used in the first longitudinally-extending component are a fluoroalcohol or a halogenated polymer, in order to aid adhesion of the first longitudinally-extending component and the second longitudinally-extending component. Other additives can be used, and their identity and the circumstances making their use desirable will be clear to one skilled in the art. Typically, such additives are added in amounts of less than about 20 wt %, and preferably less than about 10 wt %, depending upon the type of additive utilized.

The concentration of the polymer in the first longitudinally-extending component can be varied depending on the polymer selected for use, the presence of other additives in the first longitudinally-extending component, and the composition of the second longitudinally-extending component. Preferably, the concentration of filament-forming polymer in the first longitudinally-extending component can be from about 80.0 wt % to 100.0 wt %. The remaining 0.0 wt % to about 20.0 wt % can comprise nucleating agents, colorants, halogenated polymers, and other additives as described above. In a preferred embodiment, the first longitudinally-extending component comprises about 95 wt % nylon 6,6 and about 5 wt % nylon 6.

The second longitudinally-extending component of the filament comprises a melt-processible halogenated polymer. Halogenated polymers that may be useful as the sheath polymer in this invention include (but are not limited to) poly (ethylene chlorotrifluoroethylene) (ECTFE), amorphous fluoropolymers (AF), perfluoralkoxy perfluoropolymers (PFA), fluorinated ethylene-propylene copolymer (FEP), poly(ethylene-tetrafluoroethylene) (ETFE), chlorotrifluoroethylene polymer (CTFE), poly(vinylidene fluoride) (PVDF), poly(vinyl fluoride) (PVF), poly(vinyl chloride) (PVC), etc. Other useful halogenated polymers may be based on the above or on combinations of various halogenated monomers such as VDF, TFE (tetrafluoroethylene), HFP (hexafluoropropylene), PMVE (perfluoromethyl vinyl ether), PVE (perfluoropropyl vinyl ether), for example, THV terpolymer (TFE-HFP-VDF). Further surface active polymers include mixes of the above or similar polymers, or of non-halogenated polymers such as a nylon, polyester, or polyolefin, with melt-blended additives such as poly (tetrafluoroethylene) (PTFE), etc. A preferred melt-processible halogenated polymer that can be used in the present invention is a 1:1 alternating copolymer of ethylene and chlorotrifluoroethylene (hereinafter "poly(ethylene chlorotrifluoroethylene);" commercially available from Ausimont Inc., trade name HALAR(®). All references herein to "halogenated polymers" should be taken to mean "melt-processible halogenated polymers" unless otherwise indicated. All references herein to "HALAR®" should be taken to mean "poly(ethylene chlorotrifluoroethylene)." Halogenated polymers in the second longitudinally-extending component provide low surface energy to the filament.

The second longitudinally-extending component can also include additives such as flame retardants, lubricants, surfactants, nucleating agents, colorants, and anti-microbial additives, among others. Nucleating agents and colorants are as described above. Anti-microbial additives, for example zinc oxide, can be added to enhance the useful life of the filaments and fabrics made therefrom in medical applications. Other additives can be used, and their identity and the circumstances making their use desirable will be clear to one skilled in the art. It is desirable that any such additives not lower the contact angle below 90 degrees.

The concentration of the halogenated polymer in the second longitudinally-extending component can be varied depending on the halogenated polymer selected for use, the presence of other additives in the second longitudinally-extending component, and the composition of the first longitudinally-extending component. Preferably, the concentration of halogenated polymer in the second longitudinally-extending component can be from about 80.0 wt % to 100.0 wt %. The remaining 0.0 wt % to about 20.0 wt % can comprise flame retardants, lubricants, surfactants, nucleating agents, colorants, anti-microbial additives, and other additives as described above.

It is to be noted that the first longitudinally extending component can comprise two or more melt-processible, fiber-forming polymers, including, but not limited to polyamides (e.g. nylons), polyesters (e.g., PET, PBT, 3GT, PTT, etc.), polyolefins (e.g., polypropylenes, polyethylene, poly (methyl pentene), etc.) or other filament-forming polymer, and that the second longitudinally-extending component can comprise two or more halogenated polymers. In either case, the sum of the concentrations of polymers in the first longitudinally-extending component or in the second longitudinally-extending component preferably will be between about 80.0 wt % and 100.0 wt %. Additives as described above can also be added to either or both of the first longitudinally-extending component or the second longitudinally-extending component. The two or more polymers in the first longitudinally-extending component may be blended, or they may form separate layers, e.g. an outer layer surrounding an inner layer, the inner layer having a circular, pentalobal, or other cross-section; an outer layer consisting of longitudinal stripes over the inner layer; and other combinations of inner and outer layers readily envisioned by one of skill in the art.

Preferably, the percentages by total filament weight of the first longitudinally-extending component and the second longitudinally-extending component can be from about 30%/70% (first/second component) to about 70%/30% (first/second component). First longitudinally-extending component percentages of less than about 30% will yield filaments with strength less than 2.0 g/den due to high levels of halogenated polymers; first longitudinally-extending component percentages of more than about 70% will yield filaments with first longitudinally-extending components insufficiently surrounded by second longitudinally-extending components to have a contact angle greater than or equal to 90 degrees. In order to reduce the materials expense associated with halogenated polymers, it is more preferable to have percentages by total filament weight of first longitudinally-extending component and second longitudinally-extending component components to be at least about 50%/50% (first/second component), and even more preferably at least about 60%/40% (first/second component).

The denier (g/9000 m) per filament ("dpf") of the filament can be of any value known in textile filaments, typically in the range of from about 0.7 dpf to about 5.0 dpf. Preferably, the denier per filament ranges from about 1.0 dpf to about 4.0 dpf.

In one embodiment of the invention, the filament comprises a core of 100 wt % polybutylene terephthalate (about 50% of filament by weight) and a sheath of 100 wt % melt-processible halogenated polymer (about 50% of filament by weight), in which the core has a circular cross-section and the sheath surrounds the core.

In another embodiment of the invention, the filament comprises a core of 100 wt % nylon 6,6 (about 50% of filament by weight) and a sheath of 100 wt % melt-processible halogenated polymer (about 50% of filament by weight), in which the core has a circular cross-section and the sheath surrounds the core.

In further embodiment of the invention, the filament comprises a core of about 95 wt % nylon 6,6 and about 5 wt % solution-pigmented melt-processible halogenated polymer (about 50% of filament by weight) and a sheath of 100 wt % melt-processible halogenated polymer (about 50% of filament by weight), in which the core has a circular cross-section and the sheath surrounds the core.

In yet another embodiment of the invention, the filament comprises a core of 100 wt % nylon 6,6 (about 50% of filament by weight) and a sheath of about 95 wt % unpigmented melt-processible halogenated polymer and about 5 wt % pigmented melt-processible halogenated polymer (50% of filament by weight), in which the core has a circular cross-section and the sheath surrounds the core.

In yet a further embodiment of the invention, the filament comprises a core of a copolymer of about 95 wt % nylon 6,6 and about 5 wt % nylon 6 (about 50% of filament by weight) and a sheath of 100 wt % melt-processible halogenated polymer (about 50% of filament by weight), in which the core has a circular cross-section and the sheath surrounds the core.

In a second class of embodiments of the invention, the present invention is directed to filaments comprising a first longitudinally-extending component comprising at least one filament-forming polymer as described above and a second longitudinally-extending component comprising an olefin copolymer. Preferably, the olefin copolymer is a random olefin copolymer comprising 4-methyl-1-pentene and 2–5 mol % of a C14 alkene comonomer (hereinafter the "random copolymer"). Such filaments have a contact angle greater than or equal to 90 degrees and a high tenacity. The contact angle greater than or equal to 90 degrees makes the filaments resistant to chemicals, and the high tenacity makes the filaments processible into a fabric. Hereinafter, "processible into a fabric" shall mean readily knitted or woven or both to form a fabric useful in textiles or packaging.

A filament of this embodiment has a contact angle and tenacity as described above. This provides for the filament to be both chemical-resistant and processible into a fabric. The first longitudinally-extending component and second longitudinally-extending component can be present in the "core/sheath" or "racing stripe" structure of the filament as described above.

The first longitudinally-extending component of the filament comprises at least one filament-forming, melt processible polymer, including, but not limited to polyamides (e.g. nylons), polyesters (e.g., PET, PBT, 3GT, PTT, etc.), polyolefins (e.g., polypropylenes, polyethylene, poly (methyl pentene), etc.). Preferably, the filament-forming polymer is nylon 6,6. Nylon 6,6 is known to have sufficiently high tenacity to be useful in the production of textile filaments. Nylon 6,6 used in the first longitudinally-extending component is heat stable in environments up to about 180° C. (360° F.) for up to 6 h, which allows it to retain tensile strength during curing in mold release applications. It is desirable for a filament-forming polymer to have crystallization rates and/or elongational viscosity similar to those same properties of the olefin copolymer of the second longitudinally-extending component in order to better share spinning stress.

The first longitudinally-extending component of the filament can also include additives as described above. Additional additives that can be used include the olefin copolymer, in order to aid adhesion to the olefin copolymer of the second longitudinally-extending component. The concentrations of the filament-forming polymer and any additives in the first longitudinally-extending component are as described above.

The second longitudinally-extending component of the filament comprises an olefin copolymer. Preferably, it comprises a melt-processible random olefin copolymer comprising 4-methyl-1-pentene and 2–5 mol % of a C14 alkene comonomer. The olefin copolymer provides a contact angle greater than or equal to 90 degrees to the filament. In addition, the olefin copolymer can be blended with other polyolefins. The components of the olefin copolymer are commercially available (e.g., from Airtech).

The second longitudinally-extending component can also include additives such as nucleating agents, colorants, and anti-microbial additives, among others. Nucleating agents, flame retardants, lubricants, surfactants, colorants, and anti-microbial additives are as described above. Other additives can be used, and their identity and the circumstances making their use desirable will be clear to one skilled in the art. It is desirable that any such additives not make the contact angle less than 90 degrees.

It is desirable that the second longitudinally-extending component includes a polypropylene copolymer to improve the modulus. A preferred polypropylene copolymer is $CH_3—(CH_2—CH(CH_3))_n—(CH_2—CH_2)_x—CH_3$, wherein n and x can be any integer greater than zero. Preferred polypropylene copolymers are produced by Millennium Petrochemicals Inc. under the trade name FLEXATHENE TP4380HR, and by Airtech. In one embodiment, the second longitudinally-extending component comprises about 90 wt % olefin copolymer and about 10 wt % polypropylene copolymer.

The concentration of the olefin copolymer in the second longitudinally-extending component can be varied depending on the presence of other additives in the second longitudinally-extending component and the composition of the first longitudinally-extending component. Preferably, the concentration of the olefin copolymer in the second longitudinally-extending component can be from about 80.0 wt % to 100.0 wt %. The remaining 0.0 wt % to about 20.0 wt % can comprise nucleating agents, flame retardants, lubricants, surfactants, colorants, anti-microbial additives, the polypropylene copolymer, and other additives as described above.

It is to be noted that the first longitudinally-extending component can comprise two or more polymers selected from polyamide, polyester, polypropylene, or other filament-forming polymer. In this case, the sum of the concentrations of polymers in the first longitudinally-extending component preferably will be between about 80.0 wt % and 100.0 wt %. Additives as described above can also be added to the first longitudinally-extending component. The two or more polymers in the first longitudinally-extending component may be blended, or they may form separate layers, e.g. an outer layer surrounding an inner layer, the inner layer having a circular, pentalobal, or other cross-section; an outer layer consisting of longitudinal stripes over the inner layer; and other combinations of inner and outer layers readily envisioned by one of skill in the art.

Preferably, the percentages by total filament weight of the first longitudinally-extending component and the second longitudinally-extending component can be from about 30%/70% (first/second component) to about 70%/30% (first/second component). First longitudinally-extending component percentages of less than about 30% will yield filaments with strength less than 2.0 g/den due to high levels of the olefin copolymer; first longitudinally-extending component percentages of more than about 70% will yield filaments with first longitudinally-extending component insufficiently surrounded by second longitudinally-extending component to have contact angle greater than or equal to 90 degrees and chemical resistance. In order to reduce the materials expense associated with the olefin copolymer, it is more preferable to have percentages by total filament weight of the first longitudinally-extending component and the second longitudinally-extending component to be at least about 50%/50% (first/second component), and even more preferably at least about 60%/40% (first/second component).

The denier (g/9000 m) per filament ("dpf") of the filament can be of any value known in textile filaments, typically in the range of from about 0.7 dpf to about 5.0 dpf. Preferably, the denier per filament ranges from about 1.0 dpf to about 4.0 dpf.

In an embodiment of this class of the invention, the filament comprises a core of 100 wt % nylon 6,6 (50% of filament by weight) and a sheath of about 90 wt % olefin copolymer and 10% polypropylene copolymer, in which the core has a circular cross-section and the sheath surrounds the core.

In a further aspect, the present invention relates to yarns comprising a plurality of filaments, wherein each filament is as described above.

The present invention also relates to a method for melt spinning the yarns comprising a plurality of filaments, the method comprising coextruding (1) a first molten stock comprising at least one filament-forming polymer, and (2) a second molten stock comprising at least one polymer, whereby the second molten stock forms a second longitudinally-extending component located on the first molten stock, thereby forming molten filaments, and quenching the molten filaments, a plurality of which are formed into yarn. The method can further comprise drawing the yarn. Such yarns can be melt-spun using bicomponent melt-spin techniques known in the art.

To briefly summarize an exemplary method, the stock of polymers and additives to comprise the first longitudinally-extending component (the "first stock," "first polymer formulation," or "first polymer stream") and the stock of polymers and additives to comprise the second longitudinally-extending component (the "second stock," "second polymer formulation," or "second polymer stream") are in the molten state in separate extruders. The separate first and second polymer streams are then extruded into a spin pack, the spin pack comprising separate chambers for the first and second polymer streams, each chamber containing filter media; the spin pack also comprises one or more distribution plates and a spinneret. The distribution plates divide each of the first and second polymer streams into a number of smaller melt streams equal to the number of filaments to be spun. The distribution plates direct each of these smaller melt streams into the desired filament configuration above the spinneret. The combined melt streams are then each extruded through capillaries in the spinneret. The combined melt streams are then quenched or solidified in a chimney via cross-flow air, at which point they may be at or near the final spun-yarn denier. If needed in order to achieve the desired denier and physical properties, this spun yarn may be drawn (stretched) either during the spinning process or in a separate step thereafter. Finish may then be applied and the quenched melt streams taken up onto bobbins to form the spun yarn.

A typical yarn comprises from about 25 to about 100 filaments. Also, the yarn can further comprise a lubricating finish to aid in further processing. The finish can be any standard finish known in the art. A typical, but non-limiting, finish is an emulsion of 10 wt % to 25 wt % modified vegetable oils in water, applied to a concentration of <0.2 wt % to 1.5 wt % oil per total yarn. It is to be noted that the finish is distinct from the second longitudinally-extending component, in that the second longitudinally-extending component is applied to the first longitudinally-extending component by coextrusion, whereas the finish is applied to the yarn after quenching of the coextruded bicomponent filaments to form the yarn and is typically removed in subsequent fiber and fabric processing steps.

In another embodiment of the present invention, the filaments may possess tenacities of less than 2.0 g/den if the desired product is a nonwoven fabric or web. Such a fabric or web may include filaments that contain less than about 30 wt % of the first longitudinally-extending component and greater than about 70% wt % of the second longitudinally-extending component. Additionally, the filaments of such a nonwoven fabric or web may not need to be drawn, but merely melt-blown, or its equivalent, on to a moving substrate or belt, such as described in U.S. Pat. No. 4,828,911, the entire subject matter of which is incorporated herein by reference.

According to the present invention, it has been discovered that subsequent to application of typical finish (e.g., vegetable oils, ethoxylated vegetable oils, etc.) to the filament and/or yarn, such finish being applied to the filament/yarn to aid in processing, the finish must be removed in order to provide the filament/yarn with desirous low surface energy. By removing the finish, the surface of the filament/yarn is exposed, thereby providing the filament/yarn with a contact angle greater than or equal to 90 degrees. The finish removal may be conducted at any time subsequent to filament/yarn postproduction; but it is preferably removed subsequent to fabric formation. The finish may be removed by scouring, etching, agitating, blasting, or combination thereof in an aqueous environment and may additionally include a solvent that aids in finish removal. The finish is preferably removed by scouring in an aqueous bath.

In a preferable embodiment according to the present invention, a finish is applied to the filament/yarn during processing that reduces the surface energy of the filament yarn or fabric made therefrom. The finish is preferably a partially or fully halogenated polymeric compound, and more preferably a partially or fully fluorinated polymeric compound, such as PTFE, halogenated or fluorinated oil, halogenated or fluorinated silicone oil, halogenated or fluorinated acrylic compounds, emulsifying agents or combinations thereof and the like. The halogenated polymeric compound may be applied in the form of an emulsion. FIG. 5 demonstrates the expected water-repellency behavior of an embodiment of this invention (permanent ECTFE/nylon bicomponent fabric) versus several other outerwear materials. The ECTFE sheath material would be expected to maintain its contact angle over the life of the fiber/fabric, though its initial contact angle is dependent upon the processing oils used in its manufacture (and whether or not they are subsequently removed). PTFE coatings give higher contact angles initially and for some period of time, but eventually wash and wear off. Pure nylon typically shows a surface contact angle of around 60°, much too low for water to bead and run off.

It is desirable to manipulate the method of making the yarn in order to match the quenching and crystallization rates of the first and second polymer formulations. This will enhance the elongation and tenacity of the filaments, as is known to those skilled in the art. Varying the level of airflow through the chimney during the quenching step can modify the quenching rates. Quenching and crystallization rates can be modified by altering the temperatures of the molten forms of each of the first and second polymer formulations prior to extrusion. The addition of nucleating agents and other additives may also affect quenching and crystallization rates. Altering the parameters of the spinning machine or the speed of spinning can affect quenching and crystallization rates as well. It is desirable to make the crystallization rates of the first longitudinally-extending component and the second longitudinally-extending component similar, and to make the overall quench rate not too high to produce breaks. The various ways of modifying the quenching and crystallization rates, and their results, will be clear to one skilled in the art in view of the goal of a yarn comprising filaments each with a tenacity of at least 2.0 g/d, and preferably at least about 3.0 g/d, and an elongation of 15%, and preferably at least 25%.

The filaments during or after quench may be lubricated and/or cooled with a finish stream. This applied finish can be composed of a material or a mixture of materials that aid in lubrication for the spinning process or downstream processes. This finish medium may also aid in static control or other surface properties of the yarn.

The package of yarn (the "bobbin") made via this process may then be further processed into the final yarn form using several methods: (1) continuous filament drawn or fully oriented yarn (FOY) may be produced by drawing to the final yarn strength, orientation, and residual elongation on a separate drawing machine; (2) the drawing system may include a texturing step to impart crimp or body to the yarn; (3) the drawing system may include a method of twisting the yarn along its longitudinal axis; (4) the spun yarn may be used alone or when combined with other spun packages to supply a staple draw-line. In every case, the spun yarn or POY is usually not in a form usable by a textile converter or other fiber/yarn customer, unless that customer converts the yarn into a drawn yarn or FOY.

In one embodiment of the method for melt-spinning yarns of the present invention, the quench (air flow) rate is from 0 $m^3$/min to about 2.832 $m^3$/min (0 scfm (standard cubic feet per minute) to about 100 scfm), and preferably from about 0.708 $m^3$/min to about 1.416 $m^3$/min (about 25 scfm to about 50 scfm) for a yarn of 26–52 filaments, at a windup speed of 1000–3000 m/min (mpm), for a total polymer throughput of 1.8–2.8 kg/hr (4–6 pounds/hr) per threadline position and a final spun yarn denier of 150–350. This yarn is then drawn on a drawing stand using heated, powered rolls, at an appropriate draw ratio to give the final yarn properties described above, at winder takeup speeds of 500–2000 mpm.

In a preferred embodiment, the yarn of the present invention is fabricated in a continuous single step process. Single-step production of FOY is effected in a process which combines all the steps above into a single process. This combination of steps does not mean the different machines described above are combined, but that the spinning from melt, quenching, drawing and/or texturing, and final product package collection are done in a single uninterrupted process. There is no intermediate "spun yarn" package formed; rather, the final drawn, oriented, and usable fiber or yarn package made in a process fed by raw material feedstock (the polymer source) and culminating in a package of material that can be utilized by the final customer.

In another embodiment, the yarn of the present invention is fabricated in a continuous process. Drawn yarn or FOY can be made using spun yarn or POY as the feedstock. Typically, when using POY as the feedstock, the drawing step consists of (1) a means of supplying the yarn to the drawing machine; (2) a series of rolls or other conveying units and/or pins, barriers, etc. to stretch the feed yarn and align to some extent the polymer molecules in the filaments; (3) an optional intermingling or tangling device to intertwine the individual filaments at points along the length of the threadline; and (4) a device such as a winder to take up the drawn and/or textured material onto a final product package. During the drawing of the yarn, heat may be added to increase the pliability of the yarn; typically, this can be done by using heated rolls, hated stationary or rotating pins, or radiant heat at some point in the threadline path.

There are some polymers which do not lend themselves to easy conversion to fiber via a single step process, whether due to inherent polymer properties or due to the demands of the final fiber, which may require extra handling or extra care in processing. Halogenated polymers possess physical properties (e.g., Theological , etc.) that are significantly different from typical fiber-forming polymers, such as polyamides, polyesters and polyolefins. These differences in properties present difficulties in bicomponent fiber formation, and affect the resulting fiber characteristics. For example, low flux capillaries in the spin pack from which each component issues may lead to inconsistent and halting flow, thereby causing ripples, ridges or even interruptions in one or both components, which results in inadequate surface properties, especially for textile applications. Because halogenated polymers typically possess rheological properties much different from fiber-forming polymers, problems with surface properties are further exacerbated, especially in sheath-core type configurations. Halogenated polymers are typically amorphous in nature and tend to deform readily during processing, especially when utilized as the sheath. Most of the deformation occurs during the drawing step of the fiber, as is demonstrated by FIGS. 1 and 2. FIG. 1 is a scanning electron micrograph of bicomponent fiber cross-sections of spun but not drawn fibers in which nylon 6,6 is utilized as the core and Halar® is utilized as the sheath. FIG. 2 depicts such a bicomponent fiber after being drawn in a separate step and readily demonstrates fiber cross-sections that deviate considerably from circular shape, which fibers are not suitable for certain textile applications. The artisan would not have expected amorphous or largely amorphous polymers to form smoother and more concentric fiber products at higher drawing speeds. However, according to the present invention, it has been discovered that single-step processes produce bicomponent fibers having cross-sections superior than those produced in multiple-step processes. For example, FIG. 3 represents cross-sections of nylon 6,6 core and Halar® sheath fibers produced utilizing a two-step process. FIG. 4 depicts cross-sections of the same fiber produced using a single-step process. The cross-sections of the fibers are significantly more circular and provide greater consistency and predictability in shape. The processing conditions for the fibers pictured in FIGS. 3 and 4 are set forth in Examples 30 and 31.

In a preferred embodiment of the present invention the bicomponent fibers are drawn at speeds of greater than 1500 meters per minute (mpm), preferably greater than 1800 mpm, and more preferably, greater than 2300 mpm. Because of the amorphous nature (e.g., crystallization is difficult to induce) of halogenated polymers, the artisan would not have expected higher draw speeds to provide improved shape retention. In contrast, the artisan would have expected increased drawing speeds to result in increased deformity of the fiber shape and a less concentric fiber cross-section.

In another embodiment the yarn of the present invention is comprised of staple filament. Staple filament can be made either via the multiple step, discontinuous process, or a single step continuous process. The main difference in end product is the form of the fiber: continuous filament, as the name implies, is an uninterrupted filament product usually wound onto a package (the bobbin), with cut ends only at the outside of the package and at the start of the package. Staple filament is cut into discrete lengths and compressed or bound into bales or other such storage packages, and is further processed into a spun yarn (not to be confused with the spun POY above) at or for the final yarn customer.

A discontinuous staple production method would start with POY as described above. This yarn would be drawn and/or textured (making the tow), treated as required with finish, steam, or other media, and cut into discrete lengths. This cut staple would then be formed into a package or placed into a container for further processing as a usable textile yarn.

A continuous staple production method would be similar to the single step continuous filament described above, but rather than sending the continuous filament product to a wound package, the fiber (the tow) would be cut into discrete lengths and formed into a package or placed into a container for further processing as a usable textile yarn.

In some cases, drawing the yarn before cutting into staple lengths is not required, e.g., for staple feedstocks which are used to make melt-blown webs, pads, or fabrics; or for tufted or needlepunched fabrics, pads, or webs. In these cases, the staple would be formed from POY manufactured as or similar to the above, and cut to appropriate lengths and packaged.

There are several reasons fiber users and converters would choose staple over continuous filament. (1) fabrics made from staple yarn usually have a distinctly noticeably different feel and appearance than fabrics made from continuous filament; (2) staple fiber may be blended with other staple fiber types to give unique end product yarns and fabrics; (3) the end-user may have staple conversion capacity available rather than continuous filament capacity; (4) the yarn diameter and packing can be modified more easily when starting with staple fiber than with continuous fiber, for many applications.

In a second embodiment of this aspect, the yarns comprise a plurality of filaments, wherein the filaments comprise a first longitudinally-extending component comprising at least one filament-forming polymer and a second longitudinally-extending component comprising the olefin copolymer. The yarns can be melt-spun using substantially the same technique as described above, with the substitution of the olefin copolymer for the halogenated polymer.

A special case of filament formation is that identical or similar to the spinning process, which supplies a melt-blown or other non-woven fabric, web, mat, or other process. In this case, the extruded filaments are expelled from the spinneret, possibly with quenching and possibly without, to a conveying or forming step. These filaments are not collected and packaged as fibers, but rather they are collected and formed into a fabric or fabric-like structure such as a web, mesh, etc. almost directly below the fiber-forming die or spinneret. The product of this process may be useful by itself as a nonwoven material or substrate for another material; as a support or scrim for other materials; as a liner or layer of material in other textile applications; or for a number of other final product uses.

The present invention is also directed to a fabric comprising a plurality of yarns as described above. In one embodiment, the filaments comprise a first longitudinally-extending component comprising at least one melt-processible, fiber forming polymer including but not limited to polyamides (e.g., nylons), polyesters (e.g., PET, PBT, 3GT PTT, etc.) and polyolefins (e.g., polypropylene, polyethylene, poly(methyl pentene), etc.), or other fiber-forming polymer and a second longitudinally-extending component comprising a halogenated polymer. In another embodiment, the filaments comprise a first longitudinally-extending component comprising at least one filament-forming polymer and a second longitudinally-extending component comprising the olefin copolymer. In either of the foregoing, in one embodiment, in the fabric the spacing between the yarns is sufficiently small to provide a barrier to liquids and sufficiently large to allow the passage of gases. This allows the fabric to resist moisture but still be breathable. In another embodiment, in the fabric the spacing between the yarns is sufficiently small to provide a barrier to both liquids and gases. This allows the fabric to function as an air-tight packaging material.

The present invention also relates to a method of making the fabric, comprising providing a plurality of yarns as described above, and weaving or knitting the plurality of yarns to provide a spacing between the yarns sufficiently small to provide a barrier to liquids and sufficiently large to allow the passage of gases, to yield the fabric. Alternatively, the weaving or knitting step may be performed to provide a spacing between the yarns sufficiently small to provide a barrier to both liquids and gases, to yield the fabric.

The weaving or knitting pattern and the spacing between yarns to provide a barrier to liquids, or to provide a barrier to both liquids and gases will vary depending on the composition of the filaments, the number of filaments per yarn, the parameters of the melt-spinning of the yarn, and the desired density and thickness of the fabric. The appropriate pattern and spacing under a given set of conditions can be readily determined by one skilled in the art.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Example 1

A halogenated sheath threadline was spun, comprising 60% core, 40% sheath by cross-sectional area (50%/50% by measured weight at pumpout). The core was 100% nylon 6,6, and the sheath was 100% HALAR®. The halogenated polymer temperature at the extruder discharge was controlled at 250° C., and the nylon polymer discharge temperature was controlled at 282° C. Threadlines of 26 filaments were generated at a total spun yarn denier of 200±30, 1000 mpm spinning speed, and with quench flow set at 50 fpm. The quenched yarn was treated with an aqueous oil emulsion spin finish of 12% oil concentration, giving 0.8% oil on yarn by weight. This yarn was in turn drawn on a separate draw-winding machine to a final denier of 90, giving 3.46 dpf for the 26 filament items. The draw ratio was therefore 2.22. Drawn items from these runs gave the following properties as measured using an Instron 5500 tabletop tensile property testing unit:

TABLE 1

| Property | Drawn Yarn Average | Spun Yarn Average |
|---|---|---|
| Breaking strength, g | 303.9 | 216.6 |
| Denier | 91.5 | 191.4 |
| Tenacity (g/den) | 3.33 | 1.13 |
| Elongation (%) | 24.4 | 110.0 |

Table 1 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

Example 2

A halogenated sheath threadline was spun according to Example 1, with the exception that the core was 95% nylon 6,6 and 5% nylon 6 on a molar basis of monomers. This yarn was in turn drawn on a separate draw-winding machine to a draw ratio of 3.00. Drawn items from these runs gave the following properties:

TABLE 2

| Property | Drawn Yarn Average | Spun Yarn Average |
|---|---|---|
| Breaking strength, g | 269.0 | 211.6 |
| Denier | 80.1 | 193.0 |
| Tenacity (g/den) | 3.35 | 1.12 |
| Elongation (%) | 18.1 | 125.4 |

Table 2 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

Example 3

The threadline of Example 2 was spun as described with the exception of being drawn to a draw ratio of 2.20. Drawn items from these runs gave the following properties, as tested as described in Example 2:

TABLE 3

| Property | Drawn Yarn Average | Spun Yarn Average |
|---|---|---|
| Breaking strength, g | 310.0 | 211.6 |
| Denier | 104.8 | 193.0 |
| Tenacity (g/den) | 2.97 | 1.12 |
| Elongation (%) | 21.4 | 125.4 |

Table 3 indicates that a drawn yarn comprising filaments comprising a core comprising at least one polymer selected from nylon, polyester, polypropylene, or other fiber-forming polymer, and a sheath comprising a halogenated polymer, has a tenacity greater than 2.0 g/den, and an elongation of at least 15%. Such a yarn is suitable for use in a fabric of the present invention.

Example 4

A halogenated sheath threadline was spun as in Example 2, with the exception that the core was 95% nylon 6,6 and 5% HALAR®. Drawn items from these runs gave the following properties:

TABLE 4

| Property | Drawn Yarn Average | Spun Yarn Average |
|---|---|---|
| Breaking strength, g | 422.6 | 280.9 |
| Denier | 104 | 267.7 |
| Tenacity (g/den) | 4.1 | 1.05 |
| Elongation (%) | 15.7 | 155.3 |

Table 4 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

Example 5

A halogenated threadline was spun as described in Example 2, with the exception that the core consisted of 100% delustered nylon 6,6, wherein the nylon 6,6 was delustered with the addition of 2.5 wt % particulate pigment into the monomers either prior to polymerization or during the polymerization stage. Drawing was done to a draw ratio of 3.5, at draw-wind processing seeds of 1000 mpm. Drawn items from these runs gave the following properties:

TABLE 5

| Property | Drawn Yarn Average | Spun Yarn Average |
|---|---|---|
| Breaking strength, g | 248.6 | 172.4 |
| Denier | 85.1 | 266.4 |
| Tenacity (g/den) | 2.92 | 0.65 |
| Elongation (%) | 11.4 | 139.4 |

Table 5 indicates that a drawn yarn comprising filaments comprising a core comprising at least one polymer selected from nylon, polyester, polypropylene, or other fiber-forming polymer, and a sheath comprising a halogenated polymer, has a tenacity greater than 2.0 g/den, and an elongation of at least 10%.

Example 6

A halogenated polymer threadline was spun as described in Example 1, with the exceptions that the core was 100% PBT, 1.6 iv (Aristech), the sheath was 100% HALAR®, and the quench flow was 210 scfm. The spun yarn was drawn to a draw ratio of 2.01. Drawn items from these runs gave the following properties:

TABLE 6a

| Property | Drawn Yarn Average | Spun Yarn Average |
|---|---|---|
| Breaking strength, g | 360 | 268 |
| Denier-No. of filaments | 134–26 | 262–26 |
| Tenacity (g/den) | 2.7 | 1.1 |
| Elongation (%) | 22 | 108 |

Table 6a indicates that a drawn yarn comprising filaments comprising a core comprising at least one polymer selected from nylon, polyester, polypropylene, or other fiber-forming polymer, and a sheath comprising a halogenated polymer, has a tenacity greater than 2.0 g/den, and an elongation of at least 15%. Such a yarn is suitable for use in a fabric of the present invention.

The wetting data for the spun and drawn yarns, as well as for pure undrawn PBT and pure melt-processible halogenated polymer, were also determined. Dispersive surface energy was measured in methylene iodide, a purely dispersive liquid. Non-dispersive work of adhesion and contact angle were measured using water as the wetting liquid. The fibers were rinsed to remove spin finish before measurement. The method of measuring surface energetics of fibers is given by Tate et al., *J. Colloid and Interface Sci.*, 177, 579–588 (1996).

Dispersive energy is a measure of oleophobicity (resistance to wetting by oils), with lower values indicating more oleophobic character. Dispersive surface energy is equivalent to the critical surface energy often reported in the literature. Non-dispersive work of adhesion in water is a measure of the polar interactions of water with surfaces and is strongly related to water wetting behavior. Lower values of work of adhesion mean less wetting. The contact angle in water is also related to wetting behavior, with higher values of contact angle indicating less wetting. Contact angles greater than 90° are indicative of a hydrophobic surface.

The dispersive energy, non-dispersive work of adhesion, and contact angle for spun and drawn PBT/ HALAR® yarns, undrawn pure PBT, and pure HALAR® are given in Table 6b.

TABLE 6b

| Fiber | Dispersive Surface Energy (mN/m) | Non-dispersive Work of Adhesion (mN/m) | Contact angle (°) |
|---|---|---|---|
| pure PBT (undrawn) | 27 | 29 | 85 |
| PBT/HALAR ® spun | 27 | 14 | 97 |
| PBT/HALAR ® drawn | 27 | 6.3 | 103 |
| pure HALAR ® | 27 | | 109 |

As can be seen from the dispersive surface energies, HALAR® does not contribute additional oleophobic character over that of pure PBT. However, HALAR® significantly increases the hydrophobic nature of the fiber surfaces, as indicated in the lower values of non-dispersive work of adhesion and increased contact angle for the PBT/HALAR® fibers over pure PBT. Such yarns are suitable for use in the present invention.

Example 7

A halogenated polymer threadline was spun as described in Example 6, with the exception that an electrically heated collar was placed in the quench chimney to retard the quench rate. The hot collar temperature was 240° C. The spun yarn was not drawn. The properties of the spun yarn were as follows:

TABLE 7

| Property | Spun Yarn Average |
|---|---|
| Breaking strength, g | 294 |
| Denier-No. of filaments | 275–26 |
| Tenacity (g/den) | 1.07 |
| Elongation (%) | 173 |

Example 8

A bicomponent threadline was spun, comprising 60% core, 40% sheath by cross-sectional area (50%/50% by measured weight at pumpout). The core was 100% nylon 6,6, and the sheath was an olefin copolymer/polyolefin blend (90%:10% wt). Two threadlines of 13 filaments were generated at a total spun yarn denier of 85, 958 mpm spinning speed, and with quench flow set at 120 cfm. The quenched yarn was treated with an aqueous oil emulsion spin finish of 10% oil concentration, giving 2.6% oil on yarn by weight. This yarn was in turn drawn on a separate draw-twisting machine to a final denier of 45, giving 3.46 dpf for the 13 filament items. The draw ratio was therefore 1.89. Drawn items from these runs gave the following properties as measured using an Instron 5500 tabletop tensile property testing unit:

TABLE 8a

| Property | Drawn Yarn Average | Spun Yarn Average |
|---|---|---|
| Breaking strength, g | 129.6 | 126.0 |
| Denier | 45.3 | 85.8 |
| Tenacity (g/den) | 2.86 | 1.47 |
| Elongation (%) | 57.9 | 201.9 |

Table 8a indicates that a drawn yarn comprising filaments comprising a core comprising at least one polymer selected from nylon, polyester, polypropylene, or other fiber-forming polymer, and a sheath comprising an olefin copolymer/ polyolefin blend, has a tenacity greater than 2.5 g/den, and an elongation of at least 15%. Such a yarn is suitable for use in a fabric of the present invention.

The wettability data for the nylon 6,6/olefin copolymer yarn and a pure nylon control were determined as described in Example 6. The results are as follows:

TABLE 8b

| Fiber | Dispersive Surface Energy (mN/m) | Non-dispersive Work of Adhesion (mN/m) | Contact angle (°) |
|---|---|---|---|
| nylon 6,6/olefin copolymer | 20 | 26 | 93 |
| pure nylon | 22 | 49 | 61 |

As can be seen from the dispersive surface energies, the olefin copolymer contributes negligible additional oleophobic character over that of pure nylon. However, the olefin copolymer significantly increases the hydrophobic nature of the fiber surfaces, as indicated in the lower values of non-dispersive work of adhesion and increased contact angle for the nylon 6,6/olefin copolymer fibers over pure nylon. Such yarns are suitable for use in the present invention.

Example 9

A bicomponent threadline was spun according to Example 8, with the exception of a 35% sheath, by cross-sectional area, of an olefin copolymer/polyolefin blend (90%:10% wt). This yarn was in turn drawn on a separate draw-winding machine to a draw ratio of 2.07. Drawn items from these runs gave the following properties:

TABLE 9

| Property | Drawn Yarn Average | Spun Yarn Average |
|---|---|---|
| Breaking strength, g | 229.0 | 219.1 |
| Denier | 73.0 | 143.1 |
| Tenacity (g/den) | 314 | 1.53 |
| Elongation (%) | 59.5 | 245.2 |

Table 9 indicates that a drawn yarn comprising filaments comprising a core comprising at least one polymer selected from nylon, polyester, polypropylene, or other fiber-forming polymer, and a sheath comprising an olefin copolymer/ polyolefin blend, has a tenacity greater than 3.0 g/den, and an elongation of at least 15%. Such a yarn is suitable for use in a fabric of the present invention.

Example 10

A bicomponent threadline was spun according to Example 9, with the exception of a 26% sheath, by cross-sectional area. This yarn was in turn drawn on a separate draw-winding machine to a draw ratio of 2.07. Drawn items from these runs gave the following properties:

TABLE 10

| Property | Drawn Yarn Average | Spun Yarn Average |
|---|---|---|
| Breaking strength, g | 193.3 | 222.0 |
| Denier | 87.3 | 181.6 |
| Tenacity (g/den) | 2.21 | 1.22 |
| Elongation (%) | 92.0 | 339.8 |

Table 10 indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 2.0 g/den, and an elongation of at least 15%. Such a yarn is suitable for use in a fabric of the present invention.

Example 11

A bicomponent threadline was spun according to Example 10, and was in turn drawn on a separate draw-winding machine to a draw ratio of 2.07. Drawn items from these runs gave the following properties:

TABLE 11

| Property | Drawn Yarn Average | Spun Yarn Average |
|---|---|---|
| Breaking strength, g | 213.0 | 221.1 |
| Denier | 89.7 | 186.8 |
| Tenacity (g/den) | 2.37 | 1.18 |
| Elongation (%) | 115.1 | 356.5 |

Table 11 indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 2.0 g/den, and an elongation of at least 15%. Such a yarn is suitable for use in a fabric of the present invention.

Examples 12–17

Bicomponent threadlines for Examples 12–17 are spun according to Example 1, except that the threadlines are not drawn. The threadlines have the following properties:

TABLE 12

| Example | Denier | Brk Str | Elong | Tenacity | # Fils | dpf |
|---|---|---|---|---|---|---|
| 12 | 344.6 | 586.5 | 60.8 | 1.7 | 26 | 13.25 |
| 13 | 422.2 | 725.3 | 88.5 | 1.72 | 26 | 16.24 |
| 14 | 487.7 | 835 | 84.3 | 1.71 | 26 | 18.76 |
| 15 | 487.5 | 797.5 | 91.4 | 1.64 | 26 | 18.75 |
| 16 | 429.4 | 673.9 | 85.4 | 1.57 | 26 | 16.52 |
| 17 | 356 | 585.6 | 98.5 | 1.65 | 26 | 13.69 |

Examples 18–29

Fully drawn bicomponent yarns were produced with process conditions summarized in the following table. The sheath polymer melt was controlled to 250° C. (unless shown otherwise), while the core polymer melt was controlled to 282° C. Threadlines of varying filament counts and varying final product deniers were produced as shown.

In every case, the molten polymers are combined in a combination of metering plates and the filament spinneret to form the bicomponent fibers (in all examples shown these were sheath-core round cross-sections, though other examples of non-round cross-sections have been obtained). The combined filaments are quenched using cross-current air, and the now-solid filaments are conveyed through finish applicators by the first machine roll (the so-called spin roll). Drawing the fibers to the final denier is done in two subsequent stages: between the spin roll and first draw roll, and between the first draw roll and second draw rolls. Total draw ratio is approximately equal to the ratio of final draw roll speed to spin roll speed. The drawn fibers are further conveyed by tensioning rolls to the winder, from which is removed the sample package which can be converted to fabrics or other fiber-based materials via a number of processes.

In examples 18, 19, 24, 25, 26, and 27, the sheath polymer was pure Halar ECTFE, and the core was pure (commercial grade) Nylon 6,6. Note that some examples varied the amount of sheath polymer present based on weight (i.e. sheath/core ratio was changed).

In examples 22 and 23, a compounded flake of Halar with ZnO (25% by weight) was added to pure Halar ECTFE to obtain the flake mixtures shown. In these two examples, "5% ZnO" means that of the sheath component, 5% was the compounded Halar and 95% was pure Halar. Likewise, "2% ZnO" means that of the sheath polymer, 2% is the ZnO compounded material and 98% is pure Halar ECTFE.

In examples 28 and 29, pure ECTFE was blended as a flake with the nylon 6,6 carrier at the ight percentage shown.

TABLE 13

| Example | 18 | 19 | 20 | 21 | 22 | 23 |
|---|---|---|---|---|---|---|
| Outer polymer(s) | Halar ECTFE | Halar ECTFE | Halar ECTFE | Halar ECTFE | Halar ECTFE + 5% ZnO in ECTFE | Halar ECTFE + 2% ZnO in ECTFE |
| Wt % Outer | 50 | 50 | 50 | 50 | 50 | 50 |
| Inner polymer(s) | Nylon 6,6 | Nylon 6,6 | 90% Nylon + 10% pigmented ECTFE | 95% Nylon + 5% pigmented ECTFE | Nylon 6,6 | Nylon 6,6 |

TABLE 13-continued

| Example | 18 | 19 | 20 | 21 | 22 | 23 |
|---|---|---|---|---|---|---|
| Filament | Sheath-core | Sheath-core | Sheath-core | Sheath-core | Sheath-core | Sheath-core |
| Quench(cfm) | 100 | 100 | 75 | 75 | 75 | 75 |
| Residual oil level (oil on yarn) % | 1.0% | 1.0% | 1.0% | 1.0% | 0.5% | 0.6% |
| Nominal total draw ratio (in-line) | 2.35 | 2.35 | 2.35 | 2.35 | 2.35 | 2.35 |
| Takeup speed (mpm) | 2560 | 2560 | 2600 | 2540 | 2290 | 2290 |
| Yarn denier | 101 | 104 | 90 | 90 | 90 | 90 |
| Yarn # filaments | 13 | 19 | 38 | 38 | 38 | 38 |
| Yarn dpf | 7.77 | 5.46 | 2.37 | 2.37 | 2.37 | 2.37 |
| Yarn elongation % | 47.3 | 45.6 | 31.4 | 26.3 | 30.6 | 28.9 |
| Yarn tenacity g/d | 2.05 | 2.50 | 2.11 | 2.40 | 3.02 | 3.00 |
| Yarn purpose and test use | Dental floss or filter media | Dental floss or filter media | Apparel | Apparel | Apparel | Apparel |

TABLE 14

| Example | 24 | 25 | 26 | 27 | 28 | 29 |
|---|---|---|---|---|---|---|
| Outer polymer(s) | Halar ECTFE | Halar ECTFE | Halar ECTFE | Halar ECTFE | Halar ECTFE | Halar ECTFE |
| Wt % Outer | 30 | 40 | 50 | 50 | 50 | 50 |
| Inner polymer(s) | Nylon 6,6 | Nylon 6,6 | Nylon 6,6 | Nylon 6,6 | Nylon 6,6 + 1% ECTFE | Nylon 6,6 + 2% ECTFE |
| Filament | Sheath-core | Sheath-core | Sheath-core | Sheath-core | Sheath-core | Sheath-core |
| Quench(cfm) | 100 | 100 | 75 | 75 | 75 | 75 |
| Residual oil level (oil on yarn) % | 0.6% | 0.6% | 0.6% | 0.6% | 0.5% | 0.5% |
| Nominal total draw ratio (in-line) | 2.35 | 2.35 | 2.35 | 2.35 | 2.33 | 2.33 |
| Takeup speed (mpm) | 2587 | 2587 | 2587 | 2603 | 2048 | 2048 |
| Yarn denier | 45 | 50 | 80 | 90 | 90 | 90 |
| Yarn # filaments | 26 | 26 | 52 | 52 | 38 | 38 |
| Yarn dpf | 1.73 | 1.92 | 1.54 | 1.73 | 2.37 | 2.37 |
| Yarn elongation % | 46.6 | 40.9 | 46.1 | 40.9 | 38.0 | 43.8 |
| Yarn tenacity g/d | 3.20 | 2.78 | 2.45 | 2.35 | 2.78 | 2.87 |
| Yarn purpose and test use | Apparel | Apparel | Apparel | Apparel | Apparel, other | Apparel, other |

Example 30

This two step fiber item started with a 480 denier, 26 filament spun yarn, drawn to 190 denier. The spun (POY yarn) was generated on a pilot machine fed by two extruders, each feeding one polymer-the two polymer streams are combined at the spin-pack spinneret as sheath-core bicomponent filaments.

TABLE 15

Spun Feedstock Settings

| Item | Spun yarn feedstock |
|---|---|
| Core polymer (large xtdr) | Nylon 66 |
| Sheath polymer (small xtdr) | ECTFE |
| Chimney air CFM | 75 |
| Pack type | Bicomponent |
| Finish type | 10% oil emulsion |
| Finish-on-yarn Target | 0.50% |
| Sheath/Core weight ratio | 50/50 |
| Target denier/thdln | 240 |
| Filaments/threadline | 26 |
| Roll 1 mpm | 1000 |
| Roll 2 mpm | 1010 |
| Winder mpm | 1020 |

TABLE 16

Drawing Settings

| Roll | Speed | Ratio | T (° C.) |
|---|---|---|---|
| Feed cyl. | 410 | 1.022 | |
| A-roll | 419 | 1.718 | 80 |
| B-roll | 720 | 1.375 | 90 |
| C-roll | 990 | 1.040 | 120 |
| D-roll | 1030 | 0.971 | 80 |
| Fric. Roll | 1000 | | |
| Total draw ratio | | 2.51 | |

Example 31

This one step fiber is produced on a spin-draw unit with the same two extruders and polymer transport systems as in the previous example, with similar polymer temperature settings. The filaments, after extrusion as sheath-core filaments from the spinneret, are quenched, lubricated with finish, conveyed by a heated "spin roll" through a series of draw rolls at progressively higher speeds, onto the final drawn yarn package. There is no intermediary spun package.

TABLE 17

Spin Draw (One Step) Example Settings

| Item | Spun yarn feedstock | Roll Temperature (° C.) |
|---|---|---|
| Core polymer (large xtdr) | Nylon 66 | |
| Sheath polymer (small xtdr) | ECTFE | |
| Chimney air CFM | 75 | |
| Pack type | Bicomponent | |
| Finish type | 10% oil emulsion | |

TABLE 17-continued

Spin Draw (One Step) Example Settings

| Item | Spun yarn feedstock | Roll Temperature (° C.) |
|---|---|---|
| Finish-on-yarn Target | 0.50% | |
| Sheath/Core weight ratio | 50/50 | |
| Target denier/thdln | 100 | |
| Filaments/threadline | 38 | |
| Roll 1 mpm | 1137 | NA |
| Roll 2 mpm | 1140 | 80 |
| Draw Roll 1 mpm | 2320 | 120 |
| Draw Roll 2 mpm | 2650 | 90 |
| Relaxation Roll mpm | 2565 | 80 |
| Takeoff Roll mpm | 2510 | |
| Winder mpm | 2560 | |

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the concept, spirit and scope of the invention. More specifically, it will be apparent that certain agents which are chemically related may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A method for producing a low surface energy filament comprising:

melting a first component comprising at least one filament-forming polymer;

melting a second component comprising at least one polymer;

extruding said first component and said second component to form a filament, wherein said second component is formed on said first component;

quenching said filament; and drawing said filament;

wherein said filament possesses a contact angle greater than or equal to 90 degrees; and wherein said filament is produced using a single uninterrupted process.

2. A method according to claim 1, wherein spin finish is applied to said filament.

3. A method according to claim 2, wherein said spin finish is selected such that said finish does not decrease said contact angle below 90 degrees.

4. A method according to claim 2, wherein said spin finish comprises a halogenated polymeric compound.

5. A method according to claim 1, wherein said filament is used to form continuous filament yarns, staple yarns, melt-blown webs, nonwoven fabrics or woven fabrics.

6. A method according to claim 1, wherein the first component forms a core of the filament and the second component forms a sheath around the circumference of the core.

7. A method according to claim 1, wherein the second component is in the form of at least one stripe on the surface of the first component.

8. A method according to claim 1, wherein the filament-forming polymer is selected from the group consisting of nylon, polyester, or and polypropylene.

9. A method according to claim 1, wherein the second component comprises a halogenated polymer.

10. A method according to claim 9, wherein the halogenated polymer is poly(ethylene chlorotrifluoroethylene).

11. A method according to claim 1, wherein the second component comprises an olefin copolymer.

12. A method according to claim 1, wherein said filament comprises a tenacity of at least 1.0 g/den.

13. A method for producing a low surface energy filament comprising, melting a first component comprising at least one filament-forming polymer;

melting a second component comprising at least one polymer;

extruding said first component and said second component to form a filament, wherein said second component is formed on said first component;

quenching said filament; and drawing said filament at a speed of greater than about 1500 meters per minute;

wherein said filament possesses a contact angle greater than or equal to 90 degrees.

14. A method according to claim 1, wherein said filament is used to form continuous filament yarns, staple yarns, melt-blown webs, nonwoven fabrics or woven fabrics.

15. A method according to claim 1, wherein the first component forms a core of the filament and the second component forms a sheath around the circumference of the core.

16. A method according to claim 1, wherein the second component is in the form of at least one stripe on the surface of the first component.

17. A method according to claim 1, wherein the filament-forming polymer is selected from the group consisting of nylon, polyester, of and polypropylene.

18. A method according to claim 1, wherein the second component comprises a halogenated polymer.

19. A method according to claim 9, wherein the halogenated polymer is poly(ethylene chlorotrifluoroethylene).

20. A method according to claim 1, wherein the second component comprises an olefin copolymer.

21. A method according to claim 13, wherein said speed is greater than about 1800 meters per minute.

22. A method according to claim 13, wherein said speed is greater than about 2000 meters per minute.

23. A method according to claim 13, wherein said speed is greater than about 2300 meters per minute.

* * * * *